US006634881B2

(12) United States Patent
Bussman et al.

(10) Patent No.: US 6,634,881 B2
(45) Date of Patent: Oct. 21, 2003

(54) BIOGAS FLARING UNIT

(75) Inventors: Wesley Ryan Bussman, Tulsa, OK (US); Tim William Locke, Glenpool, OK (US); Karl Allen Graham, Bridger, MT (US)

(73) Assignee: John Zink Company, Tulsa, OK (US)

( * ) Notice: Subject to any disclaimer, the term of this patent is extended or adjusted under 35 U.S.C. 154(b) by 0 days.

(21) Appl. No.: 09/999,738

(22) Filed: Oct. 24, 2001

(65) Prior Publication Data

US 2002/0058221 A1 May 16, 2002

Related U.S. Application Data

(62) Division of application No. 09/715,550, filed on Nov. 17, 2000, which is a division of application No. 09/198,752, filed on Nov. 24, 1998, now Pat. No. 6,231,334.

(51) Int. Cl.[7] ..... F23G 7/08

(52) U.S. Cl. ..... 431/157; 431/193; 431/278; 431/286; 431/353

(58) Field of Search ..... 431/60, 157, 191, 431/193, 202, 278, 286, 350, 353

(56) References Cited

U.S. PATENT DOCUMENTS 2,038,749 A * 4/1936 Martin ..... 431/191

2,475,911 A * 7/1949 Nathan ..... 431/353

FOREIGN PATENT DOCUMENTS

JP 57-14126 A * 1/1982 ..... 431/350

OTHER PUBLICATIONS

John Zink brochure 5225D, "*Hydrocarbon Vapor Combustion Systems for Product Terminals,*"8 pp., dated 1994.

John Zink advertisement, *MSW Management*, pp. 47–48, Mar./Apr. 1994.

John Zink Bulletin 5151, "*John Zink Biogas Flare Systems,* "1994.

* cited by examiner

*Primary Examiner*—Henry Bennett
*Assistant Examiner*—James G. Barrow
(74) *Attorney, Agent, or Firm*—James H. Marsh, Jr.; Stinson Morrison Hecker LLP

(57) ABSTRACT

A biogas flare system for burning biogas generated primarily by a landfill includes at least one burner for igniting a mixture of biogas and air. A main supply line supplies a mixture of biogas and air to the burner. A biogas supply line feeds biogas into the main supply line. An air supply line feeds air into the main supply line. A mixer structure mixes the biogas and air prior to the mixture being supplied to the burner.

10 Claims, 7 Drawing Sheets

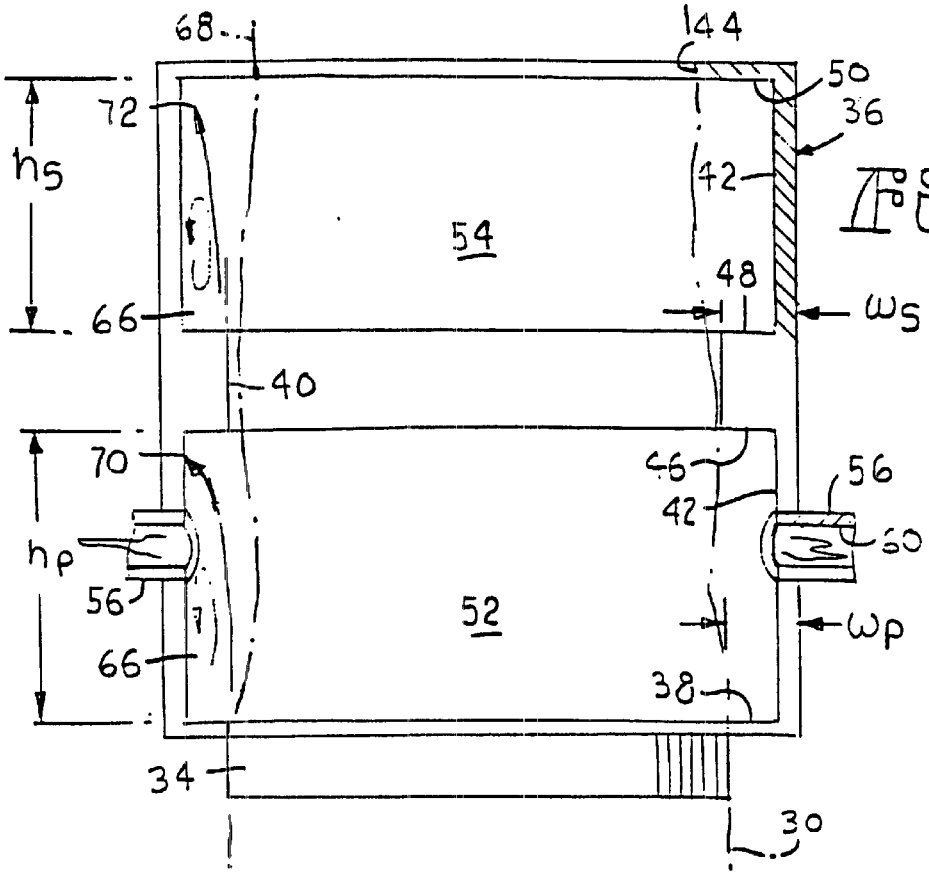
Fig. 4.
Fig. 5.
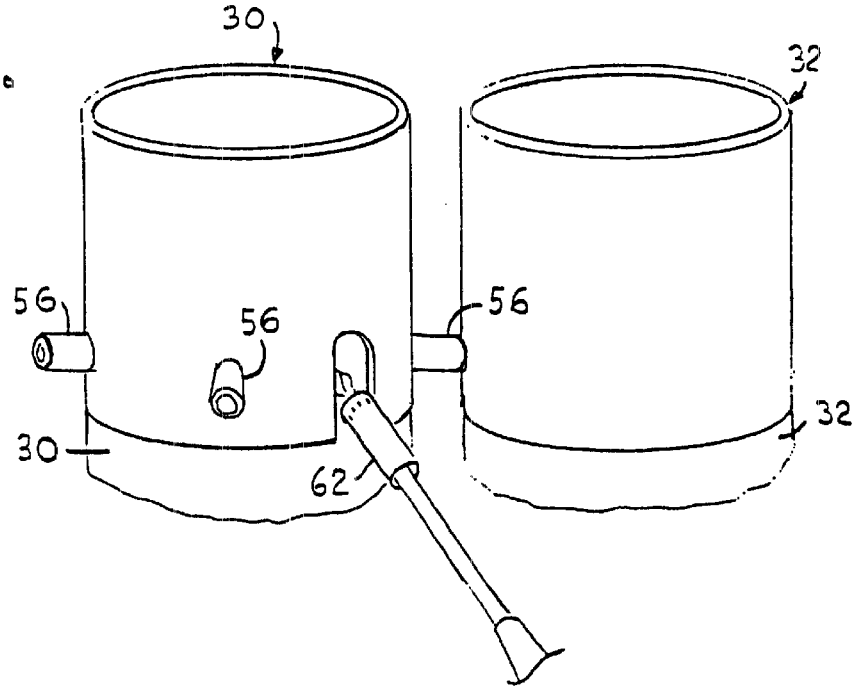

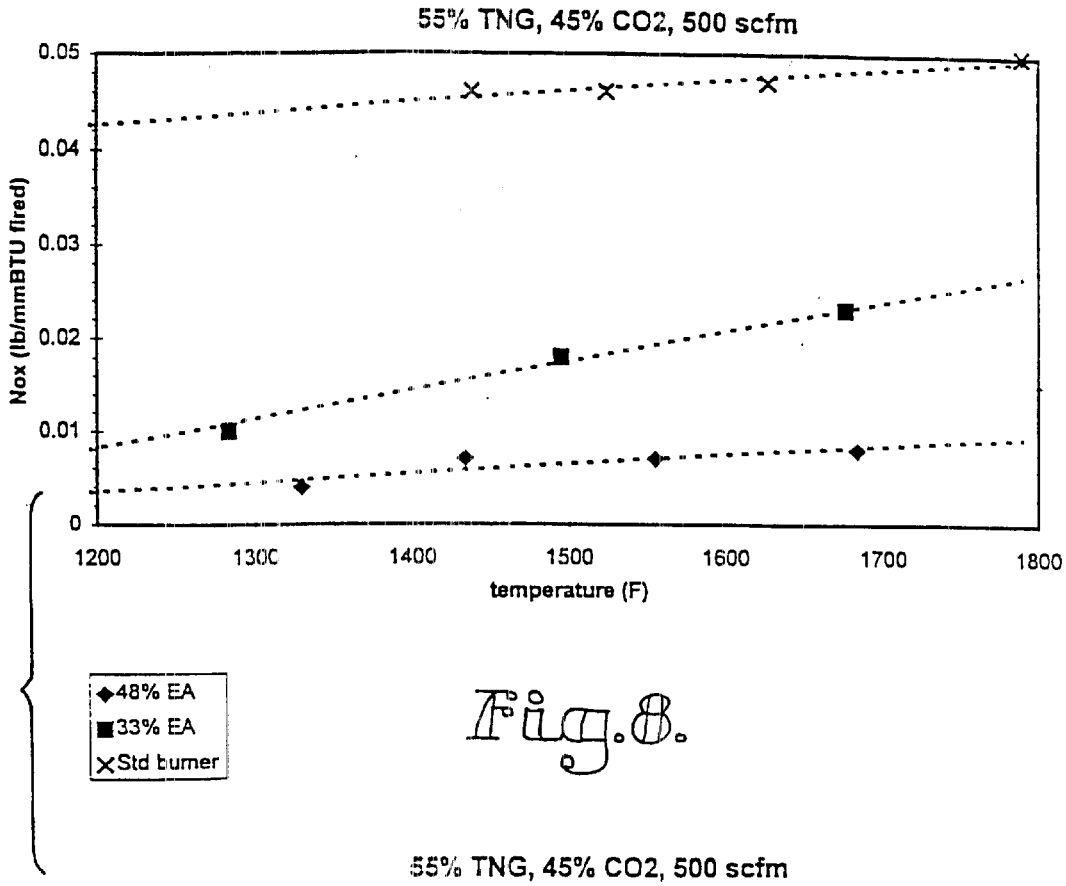
Fig. 8.
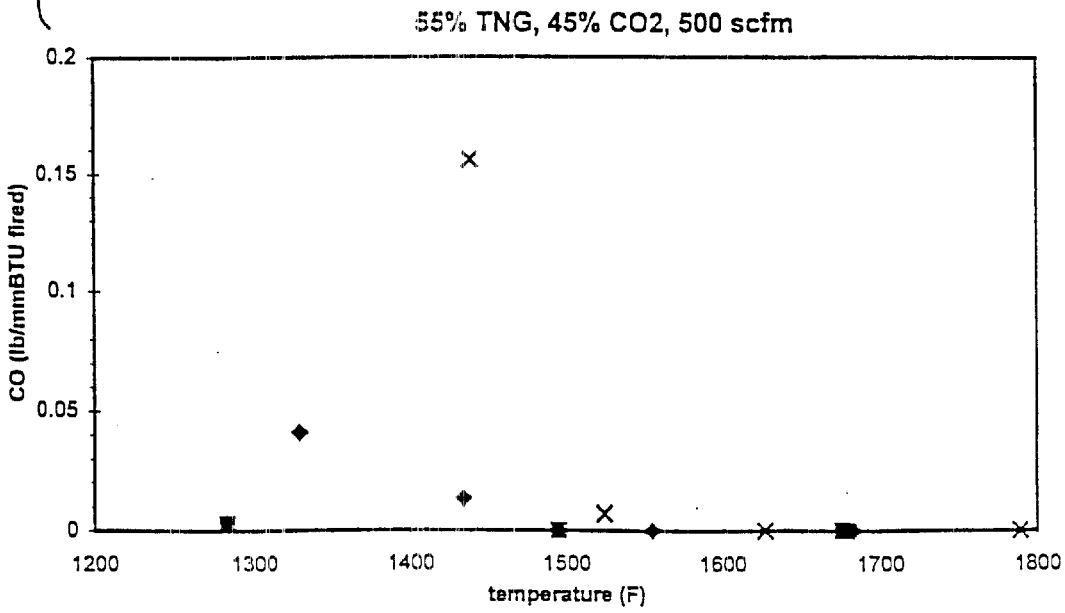

BIOGAS FLARING UNIT

CROSS REFERENCE TO RELATED APPLICATIONS

This application is a divisional of, and claims priority from, U.S. patent application Ser. No. 09/715,550, filed Nov. 17, 2000, which is a divisional of, and claims priority from, U.S. patent application Ser. No. 09/198,752, filed Nov. 24, 1998. U.S. Pat. No. 6,231,334 U.S. patent application Ser. Nos. 09/715,550 and 09/198,752 are incorporated herein in their entirety.

STATEMENT REGARDING FEDERALLY-SPONSORED RESEARCH OR DEVELOPMENT

Not applicable.

BACKGROUND OF THE INVENTION

This invention relates to a system for flaring biogas generated by landfill sites or waste water facilities, and, more particularly, to a system that decreases harmful combustion products.

In landfills and waste water treatment, oftentimes it is necessary to dispose of waste gases, such as methane, generated by the disposal and decay of biological products. Flaring systems are used to burn off or combust such biogases to prevent environmental, explosion, and worker safety hazards. Various flare units are utilized to combust the biogas. Assignee of this application manufactured a unit having a stack with a plurality of burners located therein. The burners are fed via a supply line containing biogas. The biogas is fed directly to the burners without any premixture of air. The tip of each of the burners is disposed in an aperture formed in a false bottom within a stack. The false bottom is insulated with refractory or other suitable heat-resistant material to ensure that excess heat generated by flames extending from the burner tip is not transferred to the burner manifold located below the false bottom within the stack. An annular gap exists between the burner tip and the aperture formed in the false bottom. Air from a chamber below the false bottom flows upwardly through these annular gaps and is utilized to accomplish the combustion of the biogas exiting the burner tip, and further to potentially quench the temperature in the stack if necessary to reduce and control the heat generated within the stack. The air is drawn into the chamber below the false bottom via dampers positioned in the outer wall of the stack. The dampers can be actuated to control the combustion and quench air that flows to the flame via the annular apertures in the false bottom.

This biogas flaring system suffers from various disadvantages. First, it is difficult to finely adjust the amount of combustion air utilized in the process by utilizing the air delivery structures of the prior art system. More specifically, a correct premixture of air and fuel, prior to combustion, can reduce the emissions of various harmful gases, such as nitric/nitrous oxide ($NO_x$) and carbon monoxide (CO). The prior air supply structures do not allow a proper premixing of air with fuel prior to combustion. Further, if the biogas must seek combustion air within the stack, flames will often extend upwardly from the burner tip to substantial heights, thus requiring a substantial height of the stack to conceal the flames.

In prior systems, each flame generated by a burner tip is generally unrestricted after it exits the burner tip, and oftentimes flows in a nonturbulent manner. This type of flame structure can result in an unstable flare system which can generate a significant amount of combustion instability noise. Added to the noise generated by combustion instability is the noise of the quench air flowing through the blades of the dampers located in the stack wall of the prior art system.

Therefore, a flaring system is needed which alleviates the problems of the prior art discussed above.

SUMMARY OF THE INVENTION

Accordingly, it is an object of the present invention to provide a flaring system that reduces the emission of nitric oxide.

It is a further object of the present invention to provide a flaring system which reduces the emission of carbon monoxide even at lower combustion temperatures.

A still further object of the present invention is to provide a flaring system that decreases the flame length to decrease the size of stack required.

Another object of the present invention is to provide a flaring system that reduces noise resulting from combustion and noise resulting from air flowing across the damper blades and into the stack.

Yet another object of the present invention is to provide a flaring system that increases flame temperature resulting in an increase in destruction efficiency in unburned hydrocarbons.

Accordingly, the present invention provides for at least one burner for igniting a mixture of biogas and air. A main supply line supplies the mixture to the burner. A biogas supply line feeds into the main supply line. An air supply line also feeds into the main supply line. A mixer structure is utilized to ensure that the biogas and air are mixed prior to being supplied to the burner.

The invention also provides for a flame stability device for use in conjunction with the burner. The device includes an enclosure generally surrounding and extending upwardly from a burner tip. The enclosure has an inner surface that is exposed to a flame generated from the burner tip. A stability surface extends generally from the inner surface to the burner tip. The stability surface surrounds the burner tip and creates a turbulent zone also surrounding the burner tip. The flame generated by the burner tip reattaches to the inner surface above the stability surface.

The invention further provides for an ignition arrangement for a plurality of burners. The arrangement includes at least one enclosure surrounding one of the burners and extending upwardly from the burner tip. A pilot is used to ignite the enclosed burner. An ignition port extends from the enclosed burner to at least one adjacent burner such that when the pilot lights the enclosed burner, combustion gases from the enclosed burner travel through the ignition port to ignite the adjacent burner.

Additional objects, advantages, and novel features of the invention will be set forth in part in the description which follows, and in part will become apparent to those skilled in the art upon examination of the following, or may be learned by practice of the invention.

BRIEF DESCRIPTION OF THE DRAWINGS

In the accompanying drawings which form a part of this specification and are to be read in conjunction therewith and in which like reference numerals are used to indicate like parts in the various views:

FIG. 4 is a cross-sectional view taken generally along line 4—4 of FIG. 3 and showing a flame stability device associated with a burner; and FIG. 5 is a top perspective view of two flame stability devices according to the present invention shown installed on two adjacent burners;

FIG. 8 is a graph depicting experimental results at a flow rate of 500 scfm for a different gas makeup;

DETAILED DESCRIPTION OF THE PREFERRED EMBODIMENTS

Figures 1, 2, 3:
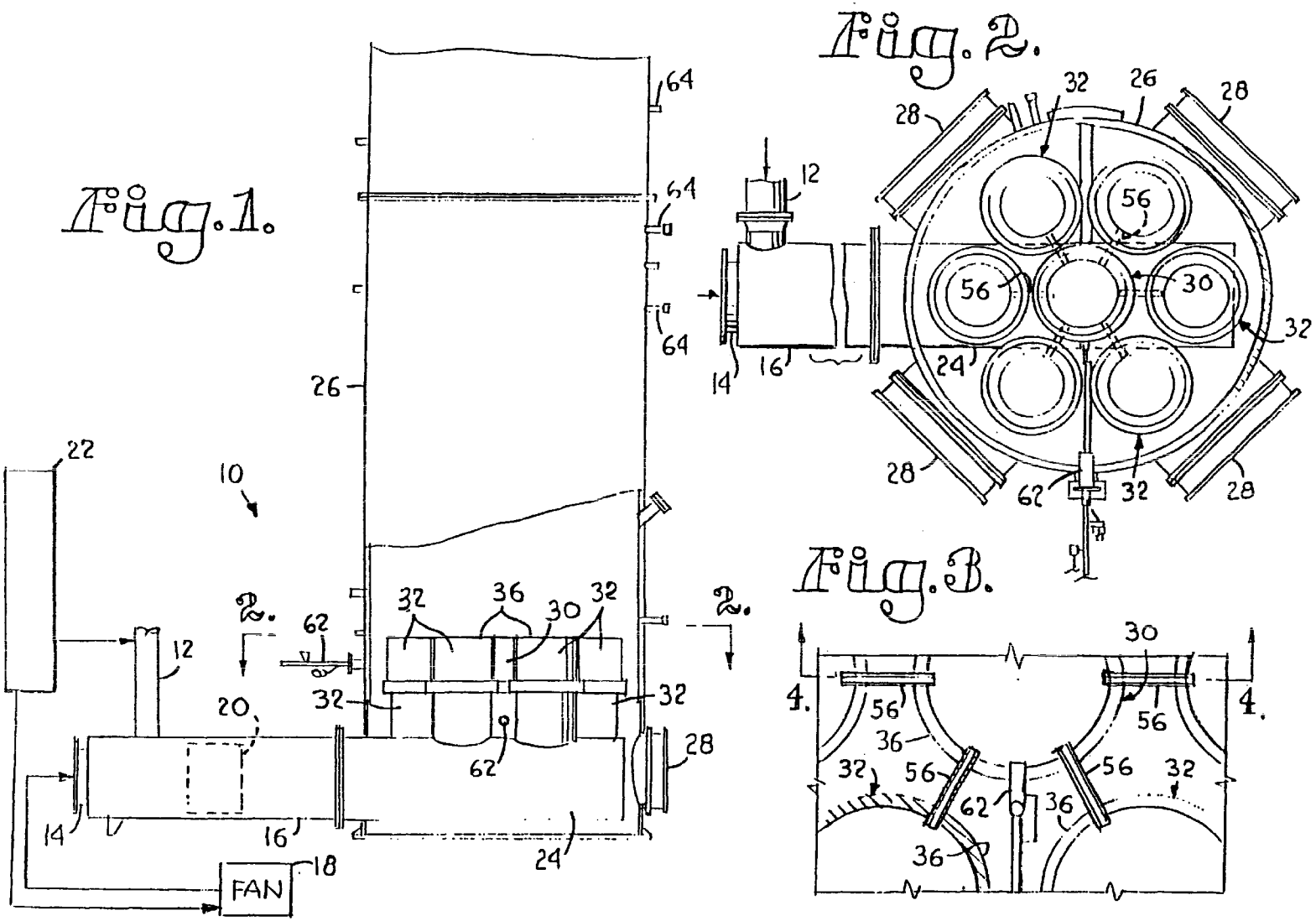
FIG. 1 is a side elevational view of a biogas flare system embodying the principles of this invention, parts being broken away and shown in cross section to reveal details of construction.
FIG. 2 is a cross-sectional view taken generally along line 2—2 of FIG. 1 and showing the arrangement of a plurality of burners utilized in the flaring system of the present invention.
FIG. 3 is an enlarged view of a portion of the central area in FIG. 2, and showing the ignition ports extending from a main burner to adjacent burners.
Figure 6:
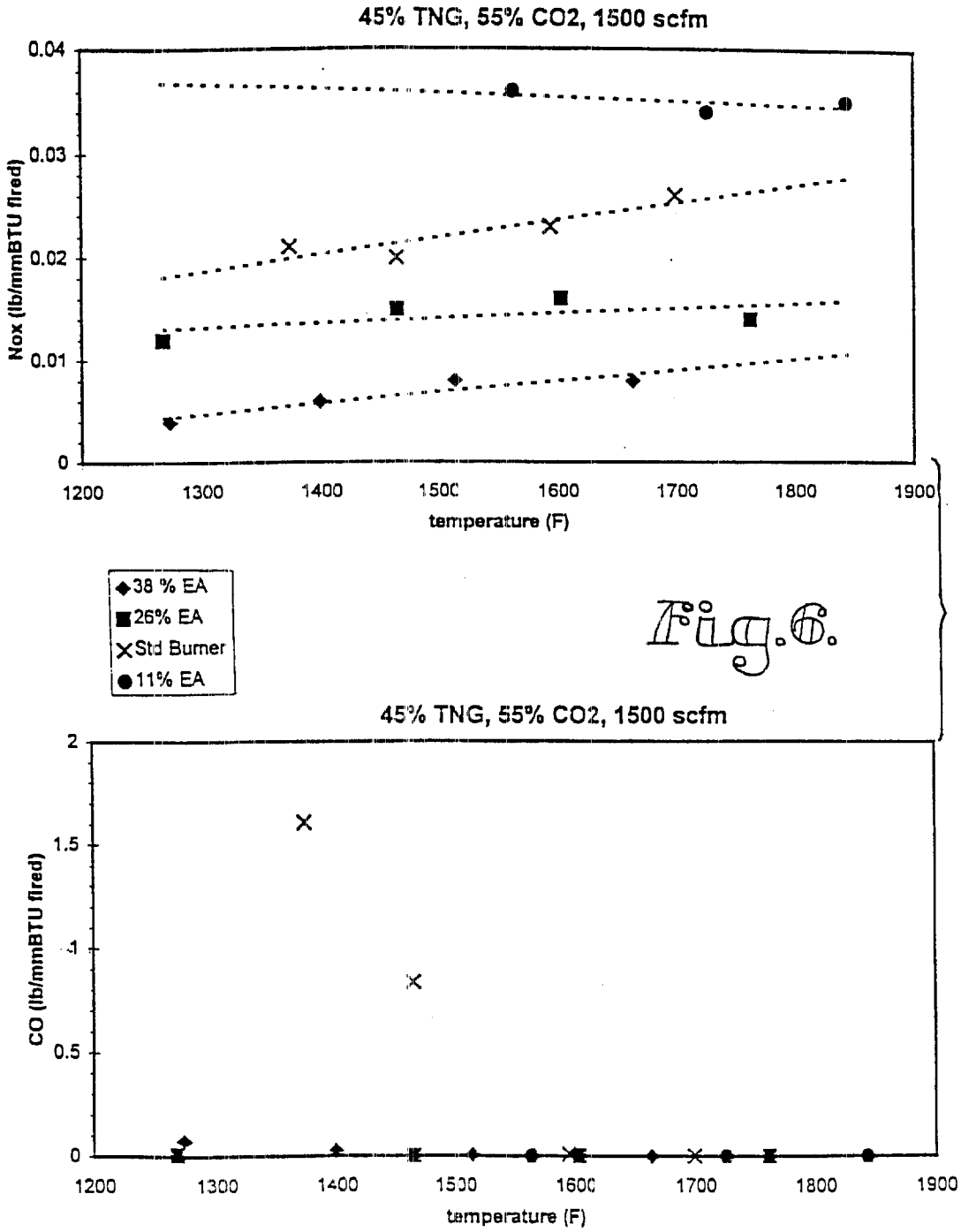
FIG. 6 is a graph depicting experimental results at a biogas (or fuel) flow rate of 1,500 standard cubic feet per minute (scfm) for a particular gas makeup.
Figure 7:
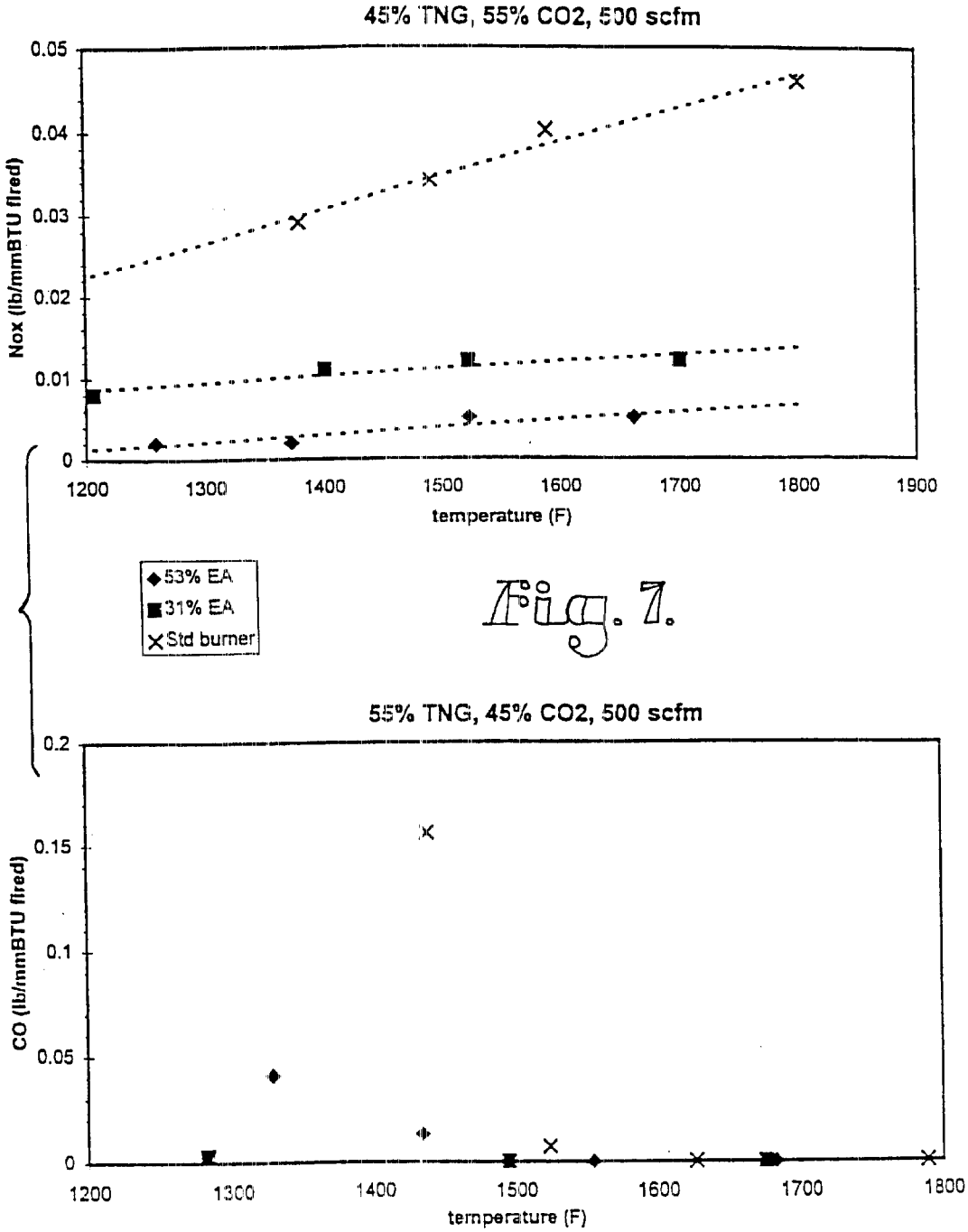
FIG. 7 is a graph depicting experimental results at a flow rate of 500 scfm for the same gas as in FIG. 6.
Figure 9:
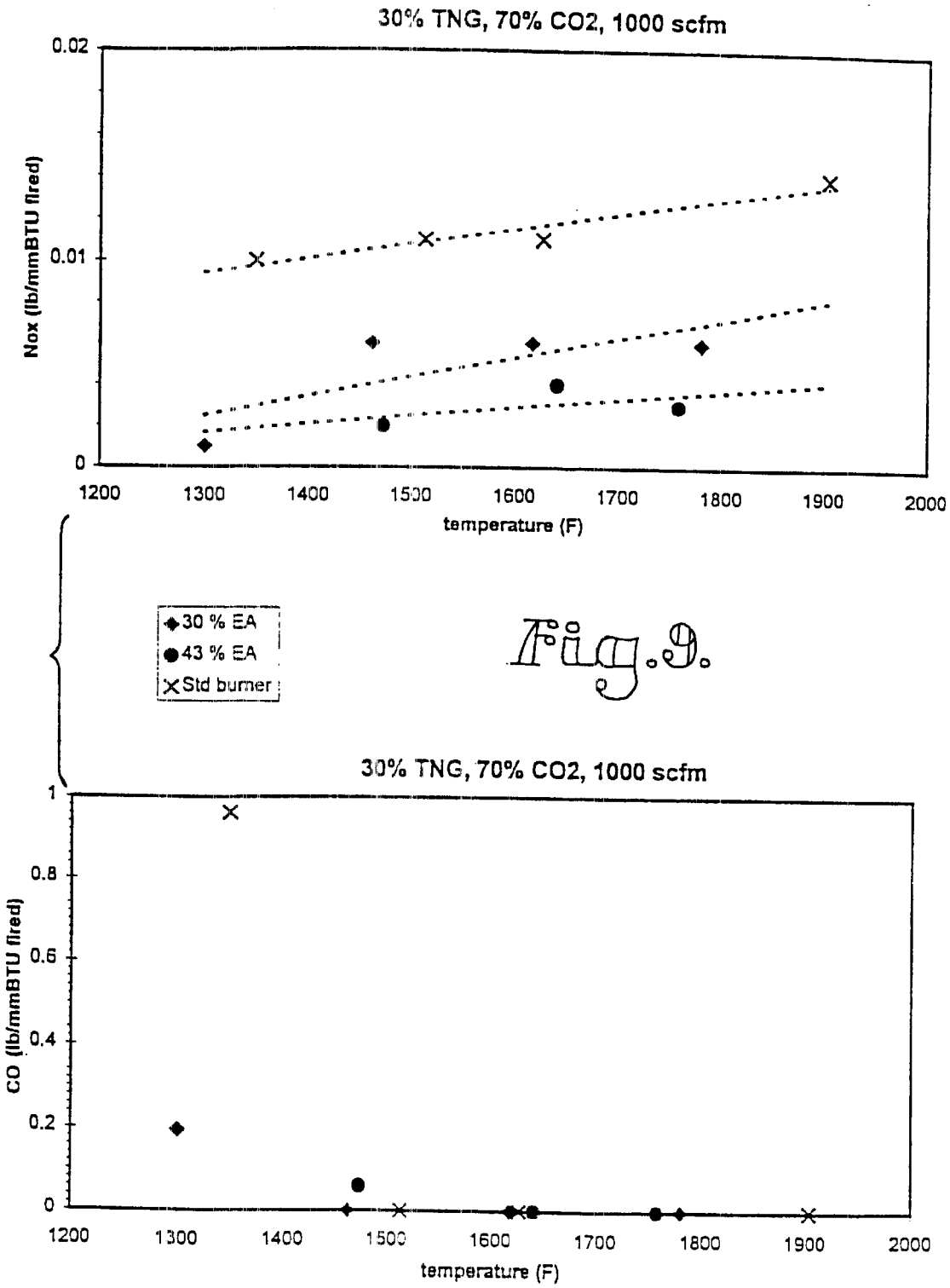
FIG. 9 is a graph depicting experimental results at a flow rate of 1,000 scfm for a still further gas makeup.
Figure 10:
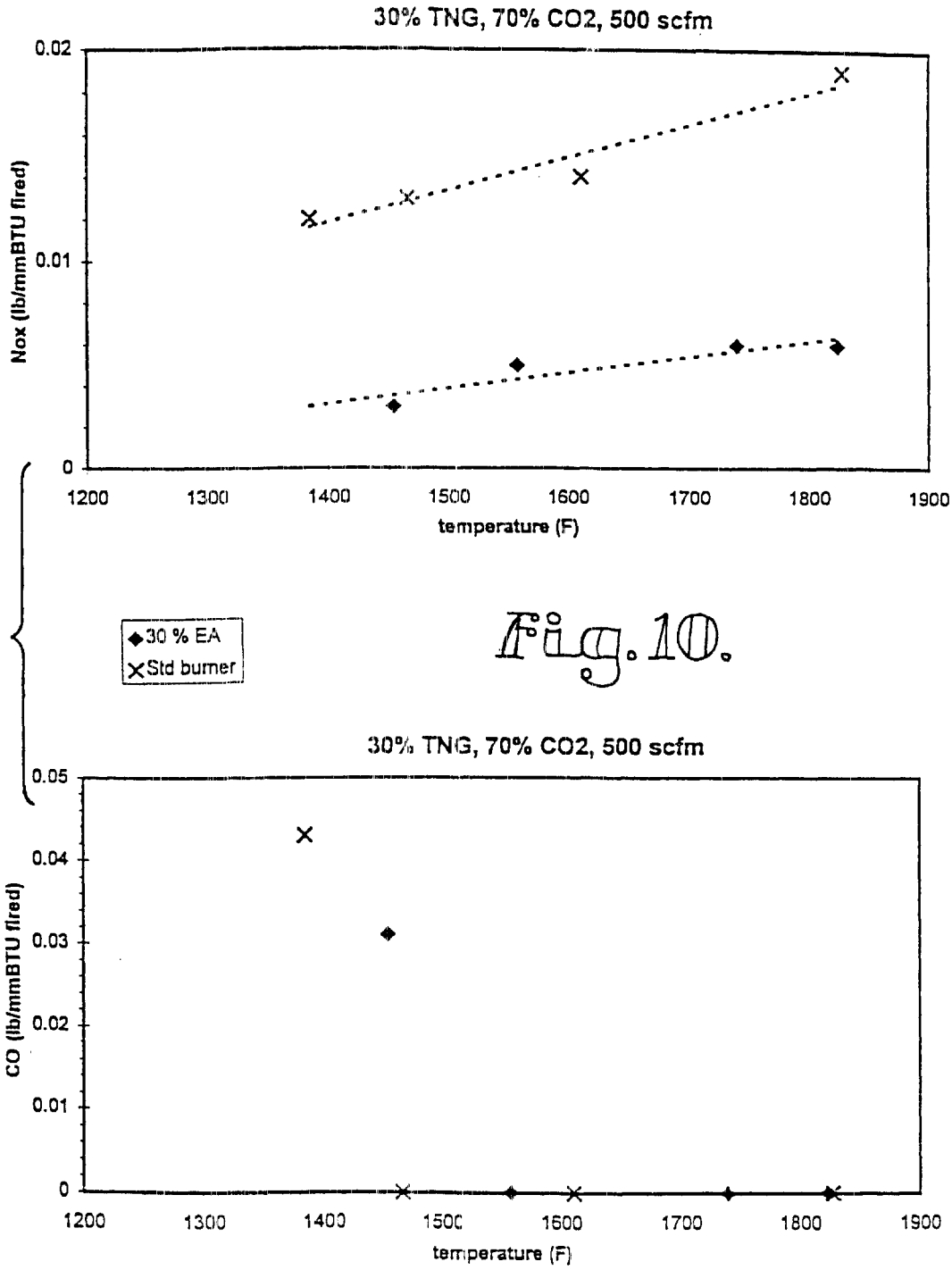
FIG. 10 is a graph depicting experimental results at a flow rate of 500 scfm for the same gas as in FIG. 9.

Referring to the drawings in greater detail, and initially to FIGS. 1–3, a biogas flaring system designated by the reference numeral 10 as shown. System 10 includes a biogas supply line 12 and an air supply line 14, which feed into a main supply line 16. Biogas in supply line 12 is introduced into the line from the landfill or waste water site where it has been collected utilizing methods and structures well known in the art. Air is introduced into supply line 14 via use of a variable speed fan 18 shown diagrammatically in FIG. 1. After air and biogas are introduced into main supply line 16, they are forced through a static mixer 20 disposed in line 16. Mixer 20 typically is of a corrugated plate variety and ensures adequate interaction between the biogas and air. One type of static mixer that has been found suitable is a mixer identified by the model number SMF-LF, manufactured by Koch Engineering Company, Inc., of Wichita, Kans.

The amount of air and biogas entering main supply line 16 from supply lines 12 and 14 is controlled by a controller 22. More specifically, controller 22 can actuate and control variable speed fan 18 and also possibly a variable speed fan (not shown) or valve coupled to line 12 in a manner well-known in the art. Controller 22 can be utilized to adjust the ratio of biogas to air, as will be more fully described below. One suitable type of controller for adjusting the biogas/air ratio is identified by the model number TSX 3721001, manufactured by Modicon of Palatine, Ill.

After gas exits mixer 20, it flows to a burner manifold 24 disposed in a generally cylindrical shell or stack 26. Stack 26 has an open top where combustion gases generated in the stack are emitted into the environment. Located adjacent the lower end of stack 26 is a plurality of motorized dampers 28. Dampers 28 are of a construction well-known in the art and are utilized to supply quench air to stack 26, as will be more fully described below. Additionally, dampers 28 can also be electrically controlled by controller 22. A suitable construction for dampers 28 can include a plurality of mutually actuated blades, or further, a single blade-type actuation mechanism.

Extending upwardly from burner manifold 24 is either one or a plurality of burners 30 and 32. More specifically, the burners are arranged in a pattern such that there is a central burner 30 and secondary burners 32 disposed and generally surrounding central burner 30, as best shown in FIGS. 2, 3, and 5. The mixture of air and biogas supplied to manifold 24 is equally divided and supplied to burners 30 and 32.

With reference to FIG. 4, each burner includes a burner tip 34 to which the biogas/air mixture is supplied and from which a flame extends upwardly. Associated with each burner tip is a generally cylindrical flame stability device or tile 36. Stability devices 36 generally surround burner tips 34 and extend upwardly therefrom. Each device 36 has a generally annular primary stability surface 38, an intermediate generally annular ridge 40 extending inwardly from an inner surface 42 of device 36, and a top generally annular lip 44 extending inwardly from inner surface 42. Ridge or ring 40 forms a generally annular primary retention surface 46 on its lower end, and a generally annular secondary stability surface 48 on its upper end. Additionally, lip 44 forms a generally annular secondary retention surface 50 adjacent its lower surface.

Primary stability surface 38 and primary retention surface 46 cooperate with inner surface 42 to form a generally cylindrical primary stability zone 52. Secondary stability surface 48 and secondary retention surface 50 cooperate with inner surface 42 to form a secondary stability zone 54. The purpose of annular surfaces 38, 46, 48, and 50 and zones 52 and 54 will be more fully described below. Stability devices 36 can be made of any suitable heat-resistant material, for instance, a ceramic refractory, or high grade stainless steel. One such suitable material is identified by the trademark THERMBOND®, available from John Zink Company (a division of Koch-Glitsch, Inc.), of Tulsa, Okla.

With reference to FIGS. 2 through 5, central burner 30 has a plurality of ignition ports 56 extending from its stability device 36 to the stability devices 36 of secondary burners 32. Ignition ports 56 are in the form of tubes, which can be made of the same material as devices 36. Each tube 56 defines an inner bore 60 which serves to spatially connect central burner 30 with each of secondary burners 32. Ports 56 are utilized to light secondary burners 32 after central burner 30 has been lit. More specifically, combustion gases in central burner 30 flow through bore 60 to ignite the adjacent burners, as will be more fully described below. Central burner 30 is lit utilizing a pilot assembly 62 which can be actuated externally of shell 26. Again, controller 22 can be utilized to automatically actuate pilot assembly 62, in a manner as is well-known in the art.

In operation, the premixing of the biogas with air in mixer 20 provides a significant advantage over prior art flare systems. More specifically, it has been found that the premixing of biogas and air prior to ignition in a burner can significantly reduce the nitric oxide and carbon monoxide emissions. More specifically, experimental data has shown that a primary air/fuel mixture can reduce nitric oxide by a factor of five to ten when compared with a conventional raw gas landfill flare. Additionally, typically carbon monoxide emissions dramatically increase as the temperature inside a conventional biogas flare decreases below approximately 1500° F. Premixing can allow the carbon monoxide emissions to remain very low, even if the temperatures in the stack decrease below 1500° F. The proper ratio of biogas to air is governed by controller 22 and is dependent upon the makeup of the biogas being flared. FIGS. 6–10 reflect experimental emissions data of the invention for various flow rates of various biogas/air mixtures for various compositions of gas compared to a standard prior art nonpremix burner. In the figures:

| | |
|---|---|
| NOx = | nitric oxide |
| CO = | carbon monoxide |
| EA = | excess air |
| TNG = | Tulsa Natural Gas (93.4% - $CH_4$; 2.7% - $C_2H_6$; 0.6% - $C_3H_8$; 0.2% - $C_4H_{10}$; 2.4% - $N_2$; 0.7% - $CO_2$) |
| $CO_2$ = | carbon dioxide |
| Std. burner = | prior nonpremix burner |

Generally, it is advantageous to have a ratio of biogas to air that has approximately 20% or greater excess air; further, a range of 20% to 50% excess air is preferable. Controller 22 is utilized in a manner well-known in the art to accomplish these ratios. It has also been found that premixing of air with biogas prior to combustion substantially reduces the soot formation in the flame resulting in a flame with a lower radiant fraction.

The premixing has been found to decrease the flame height within the stack by approximately thirty to fifty percent (30%–50%) as compared with conventional biogas flare systems.

Stability devices or tiles 36 are utilized to aid ignition of the system and provide flame stability. Devices 36 also reduce noise by blocking or shielding the combustion noise. More specifically, with reference to FIG. 4, stability zones 52 and 54 create generally annular turbulent areas 66 at locations surrounding burner flame 68. These turbulent areas 66 increase the turbulent burning velocity, thus increasing the stability of the flame. In order to maximize the turbulence and hence flame stability within areas 66, it has been found advantageous to have the width $w_p$ and $w_s$ of primary and secondary stability surfaces 38 and 48 designed such that the reattachment of the flame occurs near locations 70 and 72 which are below the locations of primary and secondary retention surfaces 46 and 50, respectively, as best shown in FIG. 4. It has been found advantageous to have the height $h_p$ of primary stability zone approximately seven to ten times the width $w_p$ of primary stability surface 38. Further, it has been found advantageous to have the height $h_s$ of secondary stability zone 54 seven to ten times the width $w_s$ of secondary stability surface 48. The ratios of these dimensions tend to allow the re-attachment of the flame prior to the primary and secondary retention surfaces 46 and 50. Preferably, a positive pressure is maintained in the primary stability zone 52. The positive pressure in primary stability zone 52 operates to force combustion gases through ignition ports 56 to light secondary burners 32. More specifically, once central burner 30 is lit utilizing pilot assembly 62, the positive pressure within primary stability zone 52 forces hot combustion gases from central burner 30 through ignition ports 56 to ignite biogas/air mixtures flowing through secondary burners 32. In this manner, each of secondary burners 32 can be easily lit simply by lighting central burner 30.

In addition to devices 36 reducing combustion noise via shielding within stack 26, the premixing of air and biogas also reduces the amount of air that must flow through dampers 28 so as to reduce the noise generated at dampers 28. More specifically, because the air is premixed with the fuel, there is no necessity for combustion air to flow though dampers 28, and only quench air flows through dampers 28. Dampers 28 can also be used and controlled by controller 22 in response to temperature sensed via thermocouple 64. The purpose of controlling the temperature inside the unit is to help reduce emissions and control potentially harmful structural temperatures and flame height.

From the foregoing, it will be seen that this invention is one well-adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims since many possible embodiments may be made of the invention without departing from the scope thereof. It is to be understood that all matter herein set forth or shown in the accompanying drawings is to be interpreted as illustrative and not in a limiting sense.

Having thus described the invention, what is claimed is:

1. A burner assemblage for a multi burner waste gas flare, said burner assemblage comprising:

a manifold for receiving and distributing a supply of a premixed mixture of waste gas and air;

a first elongated, upstanding burner having a flame generating burner tip at an upper end thereof and an inlet for a premixed mixture of waste gas and air at a lower end thereof, said inlet being connected in premixed mixture receiving relationship to said manifold;

an elongated enclosure surrounding said burner and extending upwardly from said tip said enclosure having an open top and an internal chamber for containing a flame generated at said tip;

an elongated ignition port having a first end in fluid communication with said chamber and a second end, said port being configured and arranged so as to extend outwardly from the enclosure with said second end thereof located adjacent a second burner of the flare, the arrangement being such that when the first burner is ignited, combustion gases from the chamber will travel through said ignition port to ignite the second burner; and a gas flow restriction structure located in said chamber, adjacent said tip, said structure being configured and arranged to create a positive pressure in said enclosure to enhance the flow of combustion gases through said ignition port when the first burner is ignited.

2. A burner assemblage as set forth in claim 1, comprising a second ignition port having a first end in fluid communication with said chamber and a second end, said second ignition port being configured and arranged to extend outwardly from the enclosure with said second end thereof located adjacent a third burner of the flare, the arrangement being such that when the first burner is ignited, combustion gases from the chamber will travel through said second ignition port to ignite the third burner.

3. A burner assemblage as set forth in claim 1, comprising a second elongated, upstanding burner including a flame generating burner tip at an upper end thereof and an inlet for a premixed mixture of waste gas and air at a lower end thereof, said inlet being connected in premixed mixture receiving relationship to said manifold, said burner assemblage further comprising a second elongated enclosure having an open top and an internal chamber, said second enclosure surrounding said second burner and extending upwardly from said tip of the second burner, wherein said ignition port extends between the enclosures and the second end thereof is in fluid communication with the internal chamber of the second enclosure.

4. A burner assemblage as set forth in claim 1 wherein the waste gas is a biogas.

5. An ignition arrangement for use with a multi burner waste gas flare, said arrangement comprising:

an enclosure adapted and configured so that when it is in an operable position relative to the flare it will surround a first burner of the flare and extend upwardly from a flame generating tip of the first burner, said enclosure having an open top and an internal chamber for containing a flame generated at the tip of the first burner;

an elongated ignition port having a first end in fluid communication with said chamber and a second end, said port being configured and arranged so that when the enclosure is in its said operable position relative to the first burner of the flare, said port will extend outwardly from the enclosure so as to position said second end thereof at a location adjacent a second burner of the flare, the arrangement being such that when the first burner is ignited, combustion gases from the chamber will travel through said ignition port to ignite the second burner; and a gas flow restriction structure in said chamber, said structure being located in the chamber so as to be adjacent a flame generating tip of the first burner when the enclosure is in said operable position relative to the flare, said structure being operable to create a positive pressure in said enclosure to enhance the flow of combustion gases through said ignition port when the first burner is ignited, said gas flow restriction structure comprising a ridge extending generally inwardly from an inner surface of said enclosure.

6. A waste gas flare comprising:

a manifold for receiving and distributing a supply of a premixed mixture of waste gas and air;

a plurality of elongated, upstanding burners, each said burner having a flame generating burner tip at an upper end thereof and an inlet for a premixed mixture of waste gas and air at a lower end thereof, said inlets being connected in premixed mixture receiving relationship to said manifold;

an elongated enclosure surrounding a first of said plurality of burners and extending upwardly from the tip of said first burner, said enclosure having an open top and an internal chamber for containing a flame generated at the tip of said first burner;

an elongated ignition port having a first end in fluid communication with said chamber and a second end, said port being configured and arranged so as to extend outwardly from the enclosure, said second end of the port being positioned adjacent the tip of a second burner of said plurality thereof, the arrangement being such that when the first burner is ignited, combustion gases from the chamber will travel through said ignition port to ignite the second burner; and a gas flow restriction structure located in said chamber, adjacent the tip of the first burner, said restriction structure being configured and arranged to create a positive pressure in said enclosure to enhance the flow of combustion gases through said ignition port when the first burner is ignited.

7. A waste gas flare as set forth in claim 6, comprising a second elongated ignition port having a first end in fluid communication with said chamber and a second end, said second port being configured and arranged so as to extend outwardly from the enclosure, said second end of the second port being positioned adjacent the tip of a third burner of said plurality thereof, the arrangement being such that when the first burner is ignited, combustion gases from the chamber will travel through said second ignition port to ignite the third burner.

8. A waste gas flare as set forth in claim 6, comprising a second elongated enclosure located in surrounding relationship to said second burner of the flare and extending upwardly from the tip of the second burner, said second enclosure having an open top and an internal chamber for containing a flame generated at the tip of the second burner, wherein said ignition port extends between the enclosures and the second end thereof is in fluid communication with the internal chamber of the second enclosure.

9. A waste gas flare as set forth in claim 6, wherein the waste gas is a biogas.

10. A waste gas flare comprising:

a plurality of burners, each having a flame generating tip;

an enclosure located in surrounding relationship to a first burner of the flare, said enclosure being configured and arranged so as to extend upwardly from the tip of the first burner, said enclosure having an open top and an internal chamber for containing a flame generated at the tip of the first burner;

an elongated ignition port having a first end in fluid communication with said chamber and a second end, said port being configured and arranged so as to extend outwardly from the enclosure, said second end of the port being positioned adjacent the tip of a second burner of the flare, the arrangement being such that when the first burner is ignited, combustion gases from the chamber will travel through said ignition port to ignite the second burner; and a gas flow restriction structure in said chamber, said structure being located in the chamber adjacent the tip of the first burner and being operable to create a positive pressure in said enclosure to enhance the flow of combustion gases through said ignition port when the first burner is ignited, said gas flow restriction structure comprising a ridge extending generally inwardly from an inner surface of said enclosure.

* * * * *